United States Patent [19]

Kondo et al.

[11] 4,423,132

[45] Dec. 27, 1983

[54] ELECTROSTATIC IMAGE HOLDER HAVING INSULATING OVERLAYER OF FLUORINATED SURFACTANT

[75] Inventors: Hideyo Kondo, Toride; Hitoshi Touma, Kawasaki, both of Japan

[73] Assignee: Canon Kabushiki Kaisha, Tokyo, Japan

[21] Appl. No.: 198,459

[22] Filed: Oct. 20, 1980

Related U.S. Application Data

[63] Continuation of Ser. No. 30,838, Apr. 17, 1979, abandoned.

[30] Foreign Application Priority Data

Apr. 27, 1978 [JP] Japan ..... 53-50628

[51] Int. Cl.[3] ..... G03G 5/14

[52] U.S. Cl. ..... 430/67; 430/126; 430/49

[58] Field of Search ..... 430/67, 66, 126, 49

[56] References Cited

U.S. PATENT DOCUMENTS

| | | | |
|---|---|---|---|
| 3,901,700 | 8/1975 | Yoerger | 430/49 |
| 3,955,977 | 5/1976 | Bailey | 430/67 X |
| 4,074,009 | 2/1978 | Sanders | 430/49 |

OTHER PUBLICATIONS

Chemical Abstracts, 9th Coll., 15342 GS.

*Primary Examiner*—John D. Welsh

*Attorney, Agent, or Firm*—Fitzpatrick, Cella, Harper & Scinto

[57] ABSTRACT

An image-holding member for holding electrostatic images and/or toner images comprising an insulating layer on the surface, the insulating layer being composed mainly of a fluorine-containing surface active agent, a lubricant and a resin.

6 Claims, No Drawings

ELECTROSTATIC IMAGE HOLDER HAVING INSULATING OVERLAYER OF FLUORINATED SURFACTANT

This is a continuation of application Ser. No. 30,838, filed Apr. 17, 1979 now abandoned.

BACKGROUND OF THE INVENTION

1. Field of the Invention

The present invention relates to an image-holding member for holding electrostatic images and/or toner images.

2. Description of the Prior Art

As the image-holding member on which electrostatic images or toner images are formed, there are electrophotographic photosensitive members having a photoconductive layer and image-holding members having no photoconductive layer.

Structures of electrophotographic photosensitive members are different from one another depending upon desired properties of electrophotographic photosensitive members and electrophotographic processes for which the photosensitive member is used. As typical photosensitive members, there are widely used a mmeber having a photoconductive layer formed on a support and a photosensitive member having a laminate composed of an insulating layer and a photoconductive layer on a support. The photosensitive member consisting of a support and photoconductive layer is employed in the image formation based on the most popular electrophotographic process which comprises the charging, image exposing and developing steps, and further transferring step if desired. As for the photosensitive member provided with an insulating layer, such layer is formed for the purpose of protecting the photoconductive layer, improving the mechanical strength of the photosensitive member, bettering the dark decay characteristic of the member, or adapting the member to a specified electrophotographic process. Typical examples of the photosensitive members having such an insulating layer or examples of the electrophotographic process using the member having an insulating layer are disclosed, for example, in U.S. Pat. No. 2,860,048, Japanese Patent Publication No. 16429/1966, U.S. Pat. No. 3,146,145, U.S. Pat. No. 3,607,258, U.S. Pat. No. 3,666,363, U.S. Pat. No. 3,734,609, U.S. Pat. No. 3,457,070 and U.S. Pat. No 3,124,456.

To the electrophotographic photosensitive member, a predetermined electrophotographic process is applied so that an electrostatic image is formed, and then it is visualized by development.

The image-holding members excluding a photoconductive layer have an insulating layer as an image-holding layer. Some of such typical image-holding members will be given below:

(1) Image-holding member having no photoconductive layer used in the electrophotographic process which comprises forming an electrostatic image on a photosensitive member, transferring the image to said image-holding member for the purpose of improving the repeating usability of the photosensitive member, developing the transferred image and transferring the toner image to a recording material. This process is disclosed, for example, in Japanese Patent Publication Nos. 7115/1957, 8204/1957 and 1559/1968.

(2) Image-holding member having no photoconductive layer used in the electrophotographic process which comprises forming an electrostatic image on an electrophotographic photosensitive member in a screen form having a large number of fine openings by the predetermined electrophotographic process, applying corona charging treatment to the image-holding member through the electrostatic image to modulate the ion flow from the corona so that the electrostatic image is formed on the above mentioned image-holding member, developing such image with a toner, and transferring the toner image to a recording material thereby forming the final image. This process is disclosed, for example in Japanese Patent Publication Nos. 30320/1970 and 5063/1973, and Japanese Patent Laid Open No. 341/1976 as the electrophotographic process in which an electrostatic image corresponding to that formed on the photosensitive member is formed on the image-holding member.

(3) Image-holding member having no photoconductive layer employed in the electrophotographic process which comprises applying electric signal to the multi-stylus electrode to form an electrostatic image corresponding to the electric signal on the image-holding member and developing the image. The image-holding members (1)–(3) should have insulating property at the image-holding surface, but do not require a photoconductive layer.

As will be seen from the foregoing, it is very important for an image-holding member, which may be an electrophotographic photosensitive member or other member having no photoconductive layer used for holding an electrostatic latent image or toner image, to have a particular electric characteristics suitable to the electrophotographic process then used. Besides, durability and cleaning property are other important properties which such an image-holding member should have. A high durability is required when the image-holding member must be repeatedly used. The cleaning property is indispensable for determining the easiness of the removal of any residual toner adhered to the surface of the image-holding member. To obtain a clear and sharp image and also to prevent the associated cleaning means from being damaged, the cleaning property is of critical importance. For the reason, an insulating layer having excellent durability and cleaning property is desired for the purpose of improving the durability and cleaning property of the image-holding member. In order to resolve the problem, U.S. Pat. No. 3,552,850 disclosed a method of causing a lubricant to be present in an overcoat layer on a photoconductive layer. In such method, when resin used for the overcoat layer is not sufficient in the surface lubrication property, addition of a lubricant is useful for improving the surface lubrication property of the overcoat layer. However, addition of the lubricant frequently adversely affects the quality of the obtained image.

SUMMARY OF THE INVENTION

An object of the present invention is to provide an image-holding member eliminating adverse affect of a lubricant on the quality of an image.

Another object of the present invention is to provide an image-holding member which is excellent in surface lubrication property, and consequently durability and cleaning property and which is provided with an insulating layer.

According to the present invention, there is provided an image-holding member for holding electrostatic images and/or toner images comprising an insulating layer on the surface, the insulating layer being composed mainly of a fluorine-containing surface active agent, a lubricant and a resin.

DESCRIPTION OF THE PREFERRED EMBODIMENTS

An image-holding member of the present invention comprises an insulating layer composed mainly of a resin containing a fluorine-containing surface active agent and a lubricant. The fluorine-containing surface active agent is capable of preventing perfectly the above-mentioned adverse affect of the lubricant and constituting the insulating layer provided with excellent imaging property.

The fluorine-containing surface active agent used in this invention may have a highly fluorinated long chain alkyl group in the molecule. The long chain alkyl group may contain preferably 4–24 carbon atoms, and more preferable 8–16 carbon atoms.

Typical examples of the fluorine-containing surface active agent include:

| | |
|---|---|
| $C_8F_{17}SO_2\overset{\overset{R}{\vert}}{N}CH_2COOK$ | |
| $C_8F_{17}SO_2\overset{\overset{R}{\vert}}{N}CH_2CH_2O(CH_2CH_2O)_nH$ | (n = 5, 10, 15) |
| $C_8F_{17}SO_2N(CH_2CH_2CH_2OH)_2$ | |
| $C_8F_{17}RO(CH_2CH_2O)_nH$ | (n = 2–10) |
| $C_{16}F_{33}(RO)_nH$ | (n = 5–20) |
| $C_{16}F_{33}(RO)_nR$ | (n = 5–20) |
| $C_6H_5CH_2CH_2CH_2CH_2OCOCH_2CH_2\overset{\overset{R}{\vert}}{N}SO_2C_8F_{17}$ | |

and the like, wherein R represents alkyl group such as methyl, ethyl, propyl, butyl and the like; alkylene group such as methylene, ethylene, propylene, butylene and the like; aryl group such as phenyl, naphthyl and the like; and arylene group such as phenylene, naphthylene and the like.

The insulating layer may be formed, usually in such a manner that the fluorine-containing surface active agent and lubricant are contained in a layer-forming resin. The amount of the surface active agent is preferably in a range of 0.5–50% by weight, more preferably 1–30% by weight based on the total weight of the component for the insulating layer.

As the lubricant, a powder material having a lubricating action may be suitably used. Typical examples of the lubricant include resins such as polytetrafluoroethylene, fluorinated vinylidene, polystyrene, polyethylene, polyethylenetelephthalate, silicone resin, polyvinyl chloride, polytrifluorochloroethylene, Neoprene, polypropylene and the like; waxes such as fluorine-containing wax, paraffin wax, synthetic wax and the like; amides of fatty acid such as oleic amide, stearic acid amide, lauric acid amide, phthalic acid amide, capric amide, palmitic acid amide and the like; carbons such as carbon fluoride, graphite and the like; molybdenums such as molybdenum, molybdenum disulfide and the like; and other lubricants such as boron nitride, talc, metal carbonate, silicon dioxide and the like. The lubricant is preferably substantially insoluble in a general solvent. The particle size of the lubricant is preferably about 20 microns or below in the primary particle size.

The adding amount of the lubricant may be suitably determined, and it is preferably 0.5–90% by weight, particularly 5–50% by weight based on the total weight of the component for the insulating layer.

The resin used in forming the insulating layer may be any kinds of resins which have been usually employed. Such resin includes, for example polyethylene, polyester, polypropylene, polystyrene, polyvinyl chloride, polyvinyl acetate, vinyl chloride—vinyl acetate copolymer, acrylic resin, polycarbonate, silicone resin, fluorine-containing resin, epoxy resin and the like.

The insulating layer is required to have a sufficient mechanical strength. Therefore, a curable resin having an excellent mechanical strength is recommendable. In case of using such a curable resin, the effect arising from addition of the lubricant and fluorine-containing surface active agent is remarkable since the curable resin has a tendency toward lower surface lubrication property in the formed layer.

The curable resin is capable of curing by means of heat, light, electron beam and other energy. In case of heat-curable resins, curing will take place sufficiently at a room temperature depending upon nature of the resin. Particularly preferred examples of the curable resin include acrylic resin, urethane resin, polyester resin, epoxy resin, melamine resin and silicone resin.

It is advantageous for the insulating layer to contain other components, for example, isocyanates such as 2,4-tolylenediisocyanate, 4,4'-diphenylmethanediisocyanate, hexamethylenediisocyanate, phenylisocyanate, methylisocyanate, n-propylisocyanate and the like; and silane coupling agents such as vinyltriethoxysilane, vinyl-tris($\beta$-methoxyethoxy) silane, vinyltriacetoxysilane, $\gamma$-chloropropyltrimethoxysilane and the like. These components are useful in enhancing the mechanical properties of the insulating layer.

If necessary, other resin, for example thermoplastic resin may be simultaneously used to form an insulating layer.

In forming an insulating layer, such layer is more easily produced by coating than by adhering an insulating film. Further, when the coating method is applied to a drum type image-holding member, a seamless insulating layer can be obtained.

The most typical structure of the image-holding member which is an electrophotographic photosensitive member comprises a photoconductive layer between a support and an insulating layer in a laminate form. The support may be formed of suitable material, for example metal plates such as stainless steel, copper, aluminum, tin and the like, paper, sheet and resin film. The support may be dispensed with if desired.

The photoconductive layer may be formed by vapor-depositing under vacuum an inorganic photoconductive material such as S, Se, PbO, alloy or intermetallic compound containing S, Se, Te, As, Sb or the like. Sputtering method may be also utilized, in case of which a photoconductive material of a high melting point such as ZnO, CdS, CdSe, $TiO_2$ or the like can be deposited on a support to form a photoconductive layer. Further, when a photoconductive layer is formed by the coating method, there may be used the following materials: organic photoconductive materials such as polyvinylcarbazole, anthracene, phthalocyanine and the like;

those organic photosensitive materials as sensitized by a coloring matter or Lewis acid and those materials mixed with an insulating binder. Also, a mixture of an inorganic photoconductive material such as ZnO, CdS, $TiO_2$, PbO and the like with an insulating binder may be used. As the insulating binder, various resins may be used. The thickness of the photoconductive layer varies depending upon nature and characteristics of the used photoconductive material, but is usually 5–100 microns, preferably 10–50 microns.

In the structure of the image-holding member which is used as the electrophotographic photosensitive member, another insulating containing no lubricant may be further provided between the foregoing insulating layer and photoconductive layer.

Typical structures of the image-holding member having no photoconductive layer are a structure comprising an insulating layer formed on a support, and a structure comprising an insulating layer containing no lubricant on a support and a surface insulating layer containing a fluorine-containing surface active agent and lubricant overlying the former insulating layer, the latter surface insulating layer being formed by the coating method.

The insulating layer of the present invention can provide an image-holding member which is small in the surface frictional resistance and excellent in the durability as well as the imaging property. Further, such layer can prevent cleaning means from being damaged and also prevent toner from forming a film on the surface layer of the image-holding member.

The following examples are given for illustrating the present invention, but not for restricting the invention.

EXAMPLE 1

The vapor-deposition of Se was conducted onto a substrate made of aluminum in a form of drum for 35 minutes in such a manner that 200 g of Se having 99.999% purity was placed on an evaporation dish and the temperature of the evaporation source was adjusted to 300° C., the temperature of the substrate to 67° C. and the vacuum degree to $1\times10^{-5}$ Torr. The deposition operation was repeated three times to form three photoconductive layers, each having a thickness of 60 microns. One of the photoconductive layers was soaked in a liquid of photo-curable urethane resin (trade name, "SONNE", supplied by Kansai Paint Co., Ltd.) diluted to 90 cps. in the viscosity with methyl ethyl ketone and drawn up at a speed of 30 mm/min. The urethane resin deposited on the photoconductive layer was irradiated with a mercury lamp of 4 KW for 5 minutes and then cured so that an insulating layer having a thickness of 10 microns was formed. This operation was repeated three times to obtain an insulating layer having a total thickness of 30 microns on the photoconductive layer. The thus obtained photosensitive drum is hereinafter called "Sample A".

On the other hand, a photo-curable urethane resin (trade name, "SONNE") and polytetrafluoroethylene having a particle size of 0.3 micron were mixed in a mixing ratio by weight of 90:10 and dispersed by a ball mill, and the mixture was diluted with methyl ethyl ketone to adjust its viscosity to 85 cps. In the thus prepared liquid, the second photoconductive layer was soaked and drawn up at a velocity of 30 mm/min. The thus treated photoconductive layer was irradiated with a mercury lamp of 4 KW for 6 minutes to cure the urethane resin, thereby forming an insulating layer of 10 microns in thickness. This operation was repeated three times to form an insulating layer of 30 microns in total thickness. The resulting photosensitive drum is hereinafter called "Sample B".

Further, a photo-curable urethane resin (trade name, "SONNE") as mentioned above, polytetrafluoroethylene having a particle size of 0.3 micron and fluorine-containing surface active agent, $C_8F_{17}SO_2N(CH_3)CH_2COOK$, were mixed in a ratio by weight of 89:10:1 and dispersed by a ball mill, the mixture was then diluted with methyl ethyl ketone to adjust its viscosity to 85 cps. The third photoconductive layer was soaked in the liquid thus prepared and drawn up at a speed of 30 mm/min. The thus treated photoconductive layer was irradiated with a mercury lamp of 4 KW for 6 minutes to cure the urethane resin, thereby forming an insulating layer of 10 microns in thickness. This procedure was repeated three times to obtain an insulating layer of 30 microns in total thickness. The resulting photosensitive drum is hereinafter called "Sample C".

Samples A, B and C were used in the process comprising the primary negative DC charging, secondary AC discharging simultaneous with imagewise exposure, blanket exposure, dry development with positively charged toner and cleaning with a cleaning blade made of polyurethane (hardness: 70°, angle between the blade and insulating layer surface: 30°, load of the blade: 2.0 kg) to test the lubrication property, imaging property and durability of the samples. As a result, Sample A was found to have a frictional coefficient of 2.83 and to produce a violent frictional noise between the insulating layer surface and the cleaning blade. When Sample A was caused to rotate 1000 revolutions, the blade was remarkably worn out at the edge portion, and the insulating layer surface of the sample was markedly damaged. Further, the developer is liable to form a film on the surface of Sample A.

On the other hand, Sample C was found to have a frictional coefficient of 1.25 so that it may rotate smoothly and to give an excellent image. Even after 10,000 revolutions of the sample, wearing and defacement of the blade edge and cleaning damage of the insulating layer were hardly observed. Further, although the toner image was accurately examined, no black spot of toner was observed in the non-image area.

As for Sample B, it was found to have an initial frictional coefficient of 1.26 and exhibit excellent cleaning property. However, when the sample was caused to rotate 5,000 times, frictional noise between the blade and insulating layer begun to occur. As a result of examining accurately the toner image, black spots in which toner deposited in the non-image area were observed with the number of the spots being about 15 per 1,500 $cm^2$.

EXAMPLE 2

The vapor-deposition of Se-Te was conducted onto a substrate made of aluminum in a form of drum for 40 minutes in such a manner that 200 g of Se-Te alloy (Te: 10% by weight) was placed on an evaporation dish and the temperature of the evaporation source was adjusted to 320° C., the temperature of the substrate to 68° C. and the vacuum degree in the system to $1\times10^{-5}$ Torr. This procedure was repeated three times to form three photoconductive layers of 65 microns in thickness.

Photo-curable unsaturated polyester resin (trade name "UV-CM-102", supplied by Cashew Co., Ltd.) was diluted with methyl ethyl ketone to prepare a liqid having a viscosity of 90 cps. One of the three photoconductive layers was soaked in the thus prepared liquid and drawn up at a speed of 30 mm/min. The photo-curable resin layer deposited on the photoconductive layer was irradiated with a 4 KW mercury lamp for 5 minutes to cure the resin. This operation was repeated three times to form an insulating layer of 30 microns in thickness. The resulting photosensitive drum is hereinafter called "Sample D".

On the second photoconductive layer was provided an insulating layer of polyester resin having a thickness of 20 microns by repeating twice a similar procedure as mentioned above. Further, photo-curable polyester resin (trade name, "UV-CM-103", supplied by Cashew Co., Ltd.) and polyethylene having a particle size of 10 microns were mixed in a ratio by weight of 80:20 and dispersed by a reddevil, and then the mixture was diluted with methyl ethyl ketone to adjust its viscosity to 85 cps. The thus prepared liquid was coated onto the above-mentioned insulating layer by the spray method while the drum was caused to rotate. The coating was irradiated with a mercury lamp of 4 KW for 6 minutes to cure the photo-curable resin, thereby further forming an insulating layer of 10 microns in thickness. The resulting photosensitive drum is hereinafter called "Sample E".

As for the third photoconductive layer, an insulating layer of polyester resin having a thickness of 20 microns was provided thereon by repeating twice a similar procedure as that described with respect to Sample D. Further, photo-curable polyester resin (trade name, "UV-CM-103") as mentioned above, polyethylene having a particle size of 10 microns and fluorine-containing surface active agent, $C_8F_{17}SO_2N(C_2H_5)CH_2CH_2O(CH_2CH_2O)_{10}H$ were mixed in a ratio by weight of 79:20:1 and dispersed by a reddevil, and the mixture was then diluted with methyl ethyl ketone to adjust its viscosity to 85 cps. The thus prepared liquid was coated onto the above-mentioned insulating layer by the spray method while the drum was caused to rotate. The coating was then irradiated with a mercury lamp of 4 KW for 6 minutes to cure the photo-curable resin, thereby further forming an insulating layer of 10 microns in thickness. The resulting photosensitive drum is hereinafter called "Sample F".

A similar test to that described in Example 1 was carried out with respect to Samples D, E and F. As a result, Sample D was found to have a frictional coefficient of 2.78. When Sample D was caused to rotate 800 times, the blade was worn out and damaged at the edge portion, and the frictional noise between the blade and insulating layer became violent, and further inferior cleaning property was recognized.

On the other hand, Sample F was found to have a frictional coefficient of 1.02 so that the sample may rotate very smoothly and to be excellent in imaging property as well as cleaning property. Therefore, even after the sample was rotated 30,000 times, wearing of the blade edge and damage of the insulating layer were hardly confirmed. Further, film formation of the developer fused and adhered on the surface of the drum was observed in Sample D, whereas no film formation was observed in Sample F. In addition, although the toner image formed by using Sample F was accurately examined, no black spot of toner was observed in the non-image area.

As for Sample E, its initial frictional coefficient was 1.08 and therefore its cleaning property was excellent in the initial stage. However, when the sample was caused to rotate for 4,500 revolutions, the frictional noise begun to occur. Further, as a result of examining accurately the toner image formed, black spots in which toner adhered onto the non-image area were observed in an extent of about 18 black spots per 1,500 $cm^2$.

EXAMPLE 3

A support made of aluminum in a form of cylinder having a size of 200 mm $\phi \times 500$ mm was soaked in a liquid of acrylic resin (trade name, "PULSLAC No. 2000", supplied by Chugoku Marine Paints Co., Ltd.) diluted with methyl ethyl ketone to 90 cps in viscosity and drawn up at a speed of 30 mm/min. The thus treated support was irradiated with a mercury lamp of 4 KW for 5 minutes to cure the acrylic resin, thereby forming an insulating layer of 10 microns in thickness. The same procedure as above except the drawing up speed was changed to B 23 mm/min was repeated to form further an insulating layer of 5 microns in thickness. As a result, an insulating layer of 15 microns in total thickness was provided on the support. The resulting structure is hereinafter called "Sample G".

The same structure as Sample G except that the thickness of the insulating layer was changed to 10 microns was formed in a similar procedure to that described above. Further, acrylic resin (trade name, "PULSLAC No. 2000". supplied by Chugoku Marine Paints Co., Ltd.) and polyethyleneterephthalate having a particle size of 7 microns were mixed in a ratio by weight of 90:10 and dispersed by a ball mill, and the resulting mixture was then diluted with methyl ethyl ketone to prepare a liquid of 90 cps in viscosity. The above-mentioned structure was soaked in the thus prepared liquid and drawn up at a speed of 23 mm/min. After the thus treated structure was heated at 80° C. for 15 minutes, it was irradiated with a 4 KW mercury lamp for 5 minutes to cure the acrylic resin, thereby forming an insulating layer of 5 microns in thickness. The resulting sample is hereinafter called "Sample H".

In the same structure as that of Sample H, its surface insulating layer of 5 microns in thickness was formed of a mixture consisting of acrylic resin (trade name, "PULSLAC No. 2000", supplied by Chugoku Marine Paints Co., Ltd.), polyethyleneterephthalate having a particle size of 7 microns and fluorine-containing surface active agent (trade name, "FC-431", supplied by Sumitomo 3M CO., Ltd.) in a mixing ratio by weight of 85:10:5 (dispersed by a ball mill). The resulting structure is hereinafter called "Sample I".

Samples G, H and I were used as an image-holding member in the process comprising forming an electrostatic image on a CdS photosensitive member in a screen form and applying corona charging treatment to the image-holding member through the electrostatic image to modulate the ion flow from the corona so that an electrostatic image is formed on the image-holding member, followed by developing, transferring and cleaning steps. In this process, positively charged dry developer and cleaning blade made of polyurethane (hardness: 70°, angle between the blade and surface insulating layer of the sample: 30°, blade pressure: 2.0 Kg) were used. Those samples were tested with respect to the durability. As a result, Sample G was found to have a frictional coefficient of 2.70 and produce violent frictional noise between the blade and surface insulating layer. When Sample G was caused to rotate 1,100 times, remarkable wear of the blade edge and cleaning damage in the insulating layer surface were observed.

Sample I was found to have a frictional coefficient of 1.09, rotate smoothly and give an excellent image. Even after Sample I was caused to rotate 39,500 times, the edge portion of the blade was not worn out, and the developer did not form a film on the insulating layer surface. Further, as a result of examining the formed toner image, no deposition of toner to the non-image area was observed.

Sample H was found to have a frictional coefficient of 1.15 at the initial stage and exhibit excellent cleaning property. When the sample was rotated 6,200 times frictional noise begun to occur between the blade and insulating layer surface. As a result of examining the formed toner image, about 21 black spots of toner were found per 1,500 $cm^2$ in the non-image area.

In addition, the CdS photosensitive screen used in the foregoing had been prepared in the following manner. A photoconductive layer of 30 microns in thickness was formed on a wire netting made of stainless steel having a opening width of about 50 microns in such a manner that the composition of 70 parts by weight of CdS powder and 30 parts by weight of silicone resin (trade name, "KR-255", supplied by Shinetsu Kagaku Co., Ltd.) was coated onto the wire netting by spray method and dried at 30° C. for 15 minutes. Further, an insulating layer of 15 microns in thickness was formed on the photoconductive layer by the spray coating method. The insulating layer is composed of a curing agent (trade name, "CR-15", supplied by Toshiba Silicone Co., Ltd.) and silicone resin (trade name, "TSR-144", supplied by Toshiba Silicone Co., Ltd.).

The above-mentioned electrophotographic process employed for the purpose of measuring the properties of Samples G, H and I was carried out as follows: The photosensitive screen was charged to +450 V at the surface, and imagewise exposure was conducted simultaneously with AC discharging to form an electrostatic image with −50 V in the light portion and +200 V in the dark portion on the photosensitive screen. The sample (G, H, I) was disposed at the side of the stainless steel wire netting of the photosensitive screen and subjected to negative corona charging treatment through the photosensitive screen so that an electrostatic image was formed on the sample. The image was developed with a toner to form a toner image, which was then transferred to a paper at a transfer voltage of about −6 KV and further fixed.

EXAMPLES 4–7

In Sample C of Example 1, the photo-curable urethane resin, polytetrafluoroethylene and $C_8F_{17}SO_2NCH_3CH_2COOK$ were replaced, respectively, by the following resins, lubricants and surface active agents. The resulting image-holding members were found to be useful similarly to Sample C.

EXAMPLE 4

Resin: Curable melamine resin (trade name, "O-100-2", supplied by Nippon Paint Co., Ltd.)
Lubricant: Talc (5 microns in particle size)
Surface active agent: Trade name, "FC 430", supplied by Sumitomo 3M Co., Ltd.

EXAMPLE 5

Resin: Curable silicone resin (trade name, "X-12-917", supplied by Shinetsu Kagaku Co., Ltd.)
Lubricant: Polyvinylidene fluoride (8 microns in particle size)
Surface active agent: Trade name, "F-180", supplied by Dai Nippon Ink Co., Ltd.

EXAMPLE 6

Resin: Thermoplastic polyester resin (trade name, "49001", supplied by Du Pont)
Lubricant: Polyethylene (10 microns in particle size)
Surface active agent: Trade name, "F-113", supplied by Dai Nippon Ink Co., Ltd.

EXAMPLE 7

Resin: Thermoplastic epoxy resin (trade name, "PKHH", supplied by Union Carbide Co., Ltd.)
Lubricant: Paraffin wax (particle size 5 microns, molecule weight 7500)
Surface active agent: Trade name, "F-142", supplied by Dai Nippon Ink Co., Ltd.

EXAMPLE 8

Two photoconductive layers, each having a thickness of 60 microns, were formed in the same procedure as in Example 1. A vinyl chloride-vinyl acetate copolymer (trade name, "VMCH", supplied by Union Carbide Co., Ltd.) and polytetrafluoroethylene having a particle size of 0.3 micron were mixed in a ratio by weight of 100:30, and the mixture was then diluted with methyl ethyl ketone to adjust its viscosity to 150 cps. One of the photoconductive layers was soaked in the thus prepared liquid and drawn up at a speed of 30 mm/min and further dried to form an insulating layer of 10 microns in thickness. This operation was repeated three times to form an insulating layer of 30 microns in total thickness on the photoconductive layer. The thus obtained photosensitive drum is hereinafter "Sample X".

On the other hand, a vinyl chloride-vinyl acetate copolymer (trade name, "VMCH"), polytetrafluoroethylene having a particle size of 0.3 micron and fluorine-containing surface active agent (trade name, "FC-431" supplied by Sumitomo 3M Co., Ltd.) were mixed in a ratio by weight of 100:30:3 and dispersed by a ball mill. The mixture was diluted with methyl ethyl ketone to make its viscosity to 150 cps. The other photoconductive layer was soaked in the liquid thus prepared and drawn up at a speed of 30 mm/min and further dried to form an insulating layer of 10 microns in thickness. This procedure was repeated three times to an insulating layer of 30 microns in total thickness. The resulting photosensitive drum is hereinafter called "Sample Y".

Samples X and Y were subjected to the same electrophotographic process as in Example 1 to test the lubrication property, imaging property and durability of the samples. Sample X was found to have an initial frictional coefficient of 0.9 and exhibit excellent cleaning property. However, as a result of observing the formed toner image, about 120 black spots of toner were present per 1500 $cm^2$ in the non-image area.

On the other hand, Sample Y was found to have a frictional coefficient of 0.85 so that it might rotate smoothly and the obtained image was excellent. Even after Sample Y was caused to rotate 50,000 times, wear and defacement of the blade edge and damage of the insulating layer were hardly confirmed. As a result of observing the formed toner image, no black spot of toner was observed in the non-image area.

What we claim is:

1. An electrophotographic image-holding member for holding electrostatic images and toner images comprising an insulating layer formed on a surface thereof, the insulating layer consisting essentially of a fluorine-containing surface active agent, a lubricant powder for improving the surface lubrication property of the insulating layer and a resin, wherein said surface active agent is selected from the group consisting of:

$$C_{8-16}F_{17-33}SO_2\overset{\overset{R}{|}}{N}CH_2COOK$$

$$C_{8-16}F_{17-33}SO_2\overset{\overset{R}{|}}{N}CH_2CH_2O(CH_2CH_2O)_nH \qquad (n = 5, 10, 15)$$

$$C_{8-16}F_{17-33}SO_2N(CH_2CH_2CH_2OH)_2$$

$$C_{8-16}F_{17-33}RO(CH_2CH_2O)_nH \qquad (n = 2-10)$$

$$C_{8-16}F_{17-33}(RO)_nH \qquad (n = 5-20)$$

$$C_{8-16}F_{17-33}(RO)_nR \qquad (n = 5-20)$$

$$C_6H_5CH_2CH_2CH_2CH_2OCOCH_2CH_2\overset{\overset{R}{|}}{N}SO_2C_{8-16}F_{17-33}$$

wherein R is alkyl, alkylene, aryl, and arylene and said lubricant powder is selected from the group consisting of resins, waxes, fatty acid amides, carbons, molybdenums, boron nitride, talc, metal carbonates, or silicon dioxide.

2. An image-holding member according to claim 1, in which the fluorine-containing surface active agent is contained in an amount of 0.5–50% by weight based on the weight of the insulating layer.

3. An image-holding member according to claim 1, in which the lubricant is contained in an amount of 0.5–90% by weight based on the weight of the insulating layer.

4. An image-holding member according to claim 1, in which the lubricant is of primary particle size of about 20 microns or below.

5. An image-holding member according to claim 1, in which the insulating layer is formed on a photoconductive layer.

6. An electrophotographic image-holding member for holding electrostatic images and toner images comprising an insulating layer formed on a surface thereof, the insulating layer consisting essentially of a fluorine-containing surface active agent, a lubricant powder and a resin selected from polyethylene, polyester, polypropylene, polystyrene, polyvinyl chloride, polyvinyl acetate, vinyl chloride-vinyl acetate copolymer, acrylic resin, polycarbonate resin, silicone resin, fluorine-containing resin and epoxy resin, said lubricant powder for improving the surface lubrication property of the insulating layer and wherein said surface active agent is selected from the group consisting of:

$$C_{8-16}F_{17-33}SO_2\overset{\overset{R}{|}}{N}CH_2COOK$$

$$C_{8-16}F_{17-33}SO_2\overset{\overset{R}{|}}{N}CH_2CH_2O(CH_2CH_2O)_nH \qquad (n = 5, 10, 15)$$

$$C_{8-16}F_{17-33}SO_2N(CH_2CH_2CH_2OH)_2$$

$$C_{8-16}F_{17-33}RO(CH_2CH_2O)_nH \qquad (n = 2-10)$$

$$C_{8-16}F_{17-33}(RO)_nH \qquad (n = 5-20)$$

$$C_{8-16}F_{17-33}(RO)_nR \qquad (n = 5-20)$$

$$C_6H_5CH_2CH_2CH_2CH_2OCOCH_2CH_2\overset{\overset{R}{|}}{N}SO_2C_{8-16}F_{17-33}$$

wherein R is alkyl, alkylene, aryl, and arylene and said lubricant powder is selected from the group consisting of resins, waxes, fatty acid amides, carbons, molybdenums, boron nitride, talc, metal carbonates, or silicon dioxide.

* * * * *